US008522449B2

(12) United States Patent
Tuck

(10) Patent No.: US 8,522,449 B2
(45) Date of Patent: Sep. 3, 2013

(54) DRYER FOR FUEL MATERIAL

(75) Inventor: Gordon Tuck, Belmont (CA)

(73) Assignee: Altentech Power Inc., Vancouver (CA)

( * ) Notice: Subject to any disclaimer, the term of this patent is extended or adjusted under 35 U.S.C. 154(b) by 1009 days.

(21) Appl. No.: 12/117,825

(22) Filed: May 9, 2008

(65) Prior Publication Data

US 2009/0158618 A1 Jun. 25, 2009

(30) Foreign Application Priority Data

Dec. 19, 2007 (CA) ..... 2615395

(51) Int. Cl.
*F26B 13/02* (2006.01)

(52) U.S. Cl.
USPC ..... 34/179; 34/181; 34/207; 34/218

(58) Field of Classification Search
USPC ..... 34/90, 179, 181, 182, 183, 189, 190, 34/203, 207, 218, 639, 506
See application file for complete search history.

(56) References Cited

U.S. PATENT DOCUMENTS

| | | | | |
|---|---|---|---|---|
| 1,216,504 A | | 2/1917 | Schaefer | |
| 1,260,595 A | | 3/1918 | Thompson | |
| 1,695,991 A | * | 12/1928 | Bennett | 34/208 |
| 1,783,965 A | | 12/1930 | Jackson | |
| 2,095,867 A | * | 10/1937 | Hammer | 198/851 |
| 2,344,106 A | | 3/1944 | Reed | |
| 2,812,591 A | | 11/1957 | Kling | |
| 3,063,216 A | * | 11/1962 | Silverman | 95/36 |
| 3,325,912 A | * | 6/1967 | Bojner et al. | 34/169 |
| 3,699,881 A | | 10/1972 | Levin | |
| 3,738,020 A | | 6/1973 | Hanton | |
| 3,769,921 A | | 11/1973 | McMullen | |
| 3,925,963 A | * | 12/1975 | Greenawalt et al. | 53/552 |
| 3,973,329 A | | 8/1976 | Feess | |
| 4,060,041 A | | 11/1977 | Sowards | |
| 4,209,917 A | * | 7/1980 | Johnson | 34/612 |
| 4,398,356 A | | 8/1983 | Westelaken | |
| 5,203,256 A | | 4/1993 | Mueller | |
| 5,335,590 A | | 8/1994 | Crump, III et al. | |
| 3,252,435 A | | 5/1996 | Bogot | |

(Continued)

FOREIGN PATENT DOCUMENTS

| | | |
|---|---|---|
| CA | 1088300 | 10/1980 |
| CA | 2540285 | 3/2005 |
| DE | 323402 C | 7/1920 |
| GB | 550818 | 1/1943 |
| JP | 118808 B | 8/1936 |

(Continued)

*Primary Examiner* — Jiping Lu
(74) *Attorney, Agent, or Firm* — Bereskin & Parr LLP/S.E.N.C.R.L., s.r.l.

(57) ABSTRACT

The invention relates to a dryer for drying fuel materials such as wood bark, wood chips, sludge, garbage, peat moss or the like. In a preferred embodiment the dryer comprises a conveyor, consisting of twin endless belts, which carries the material to be dried along a vertical path defined between parallel runs of the endless belts, and ductwork which serves to direct heated air (received from any appropriate source) across the vertical path to remove moisture from the material as it is being conveyed. The ductwork includes at least one feed duct for use in delivering the heated air to one side of the vertical path, and at least one exhaust duct for use in withdrawing moisture-laden air on another side of the vertical path. Suction is applied at the exhaust ducts to draw drying air through the ductwork, and the feed and exhaust ducts are made to seal against the conveyor to reduce the introduction of ambient air into the dryer ductwork under the suction applied.

14 Claims, 5 Drawing Sheets

(56) References Cited

U.S. PATENT DOCUMENTS

| | | | | |
|---|---|---|---|---|
| 5,517,767 | A | 5/1996 | Schechinger | |
| 6,006,503 | A * | 12/1999 | Davison et al. | 53/551 |
| 6,230,421 | B1 | 5/2001 | Reed, Sr. et al. | |
| 6,672,251 | B1 | 1/2004 | Waanders et al. | |
| 2006/0112588 | A1 | 6/2006 | Ness et al. | |
| 2007/0125637 | A1 | 6/2007 | Merrell et al. | |

FOREIGN PATENT DOCUMENTS

| | | | |
|---|---|---|---|
| JP | S42-26402 | | 12/1967 |
| JP | S5638604 | U | 3/1981 |
| JP | 61095753 | A * | 5/1986 |
| JP | H10263460 | A | 10/1998 |
| RU | 2256133 | | 7/2005 |
| WO | WO 2004/070299 | | 8/2004 |

* cited by examiner

FIG. 4
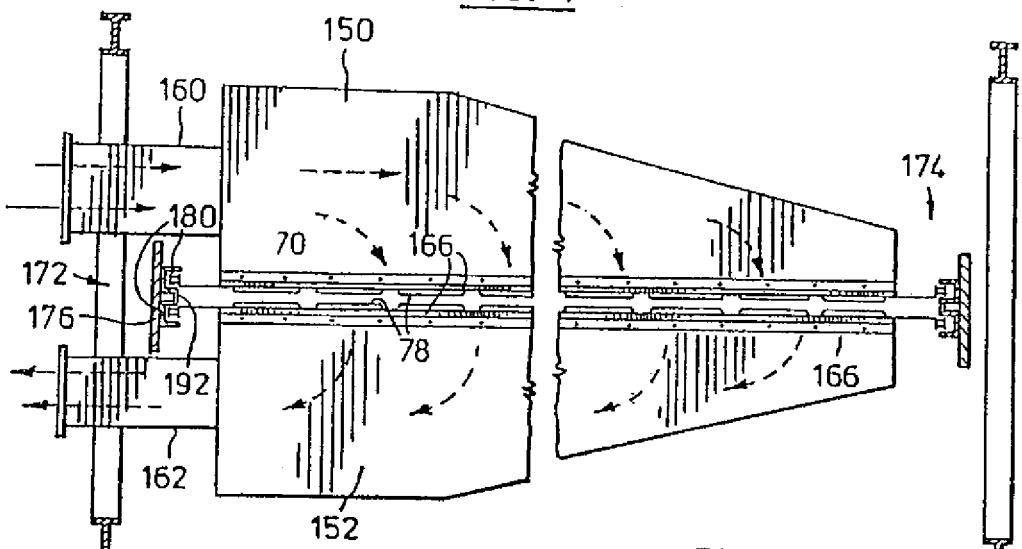
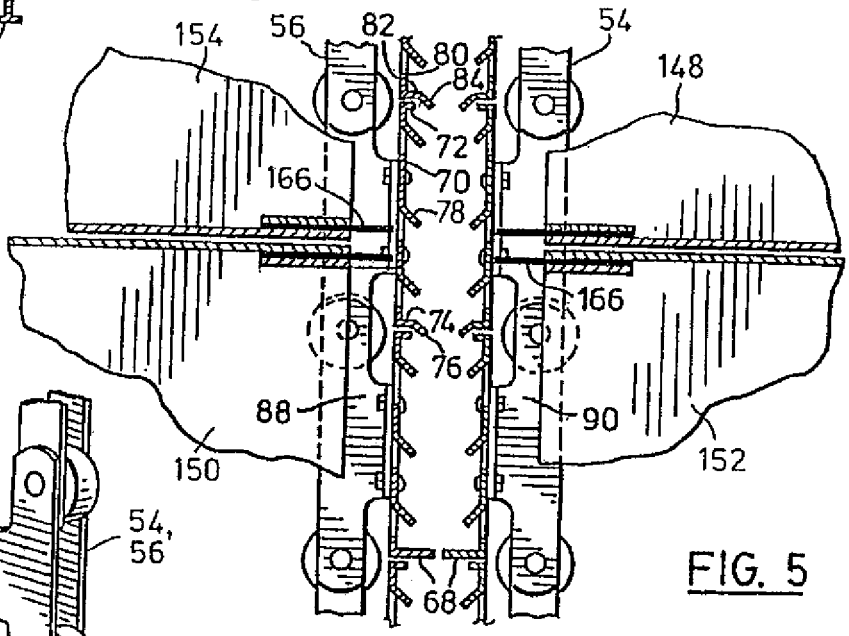
FIG. 5
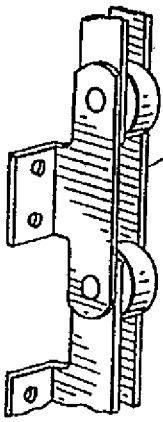
FIG. 6

DRYER FOR FUEL MATERIAL

FIELD OF THE INVENTION

The invention relates to a dryer for use in drying fuel materials such as wood bark, wood chips, sludge, peat moss or the like.

BACKGROUND OF THE INVENTION

Dryers may be used to remove moisture from a variety of fuel materials. One example of such fuel materials are peat moss or peat moss pellets that are intended to be burned as a fuel. Such products tend to have considerable moisture content because they are often stored in locations where they are exposed to the elements. When these products are used as a fuel in a burner, a substantial part of the heat energy generated during their consumption tends to be lost to a burner stack, as the moisture contained in the product is evaporated and escapes. Fuel economy can be enhanced by reducing the moisture content of these products prior to combustion.

Drying apparatuses have been used in which wood by-products have been tumbled in a rotating fashion while being subjected to drying air. This manner of drying tends to separate fine and course materials thereby providing a dried product having non-uniform burning properties. This separation of fine materials from coarse tends also to contribute to dust problems, fine particles tending to be entrained with drying air or otherwise scattered from the dryer.

SUMMARY OF THE INVENTION

According to a first aspect of the invention, a dryer for drying a material to be used as fuel is provided. The dryer comprises means for conveying the material to be dried along a substantially vertical path extending between an upper end of the conveying means, where the material is received, and a lower end of the conveying means, where the material is discharged. The dryer also includes directing means for directing a heated drying gas across the vertical path to remove moisture from the material as it is conveyed. The directing means includes a feed duct means for use in delivering the heated drying gas to the conveying means on one side of the vertical path, and an exhaust duct means for withdrawing moisture-laden drying gas from the conveying means on another side of the vertical path.

According to a second aspect of the invention, a dryer for drying a fuel material using a drying gas is provided. The dryer comprises at least one endless belt comprising a substantially vertical run. The vertical run defines a vertical path. A plurality of flights are connected to the endless belt, which conveys the material along the vertical path. At least one feed duct is located on one side of the vertical path, and is adapted for directing the drying gas substantially across the vertical path. At least one exhaust duct is located on another side of the vertical path, and is adapted for receiving the drying gas.

BRIEF DESCRIPTION OF THE DRAWINGS

The invention will be better understood with reference to drawings illustrating a preferred embodiment of the invention. In the drawings:

FIG. 4 is a plan view along lines 4-4 of FIG. 3 with extraneous detail omitted to illustrate dryer ducts and their mounting brackets;

FIG. 5 is a view along lines 5-5 of FIG. 3 detailing structure of the dryer conveying belts;

FIG. 6 is a perspective view detailing structure of the chains used to carry conveying belts in the dryer, according to an embodiment of the present invention;

DETAILED DESCRIPTION OF THE PREFERRED EMBODIMENT

Figure 1:
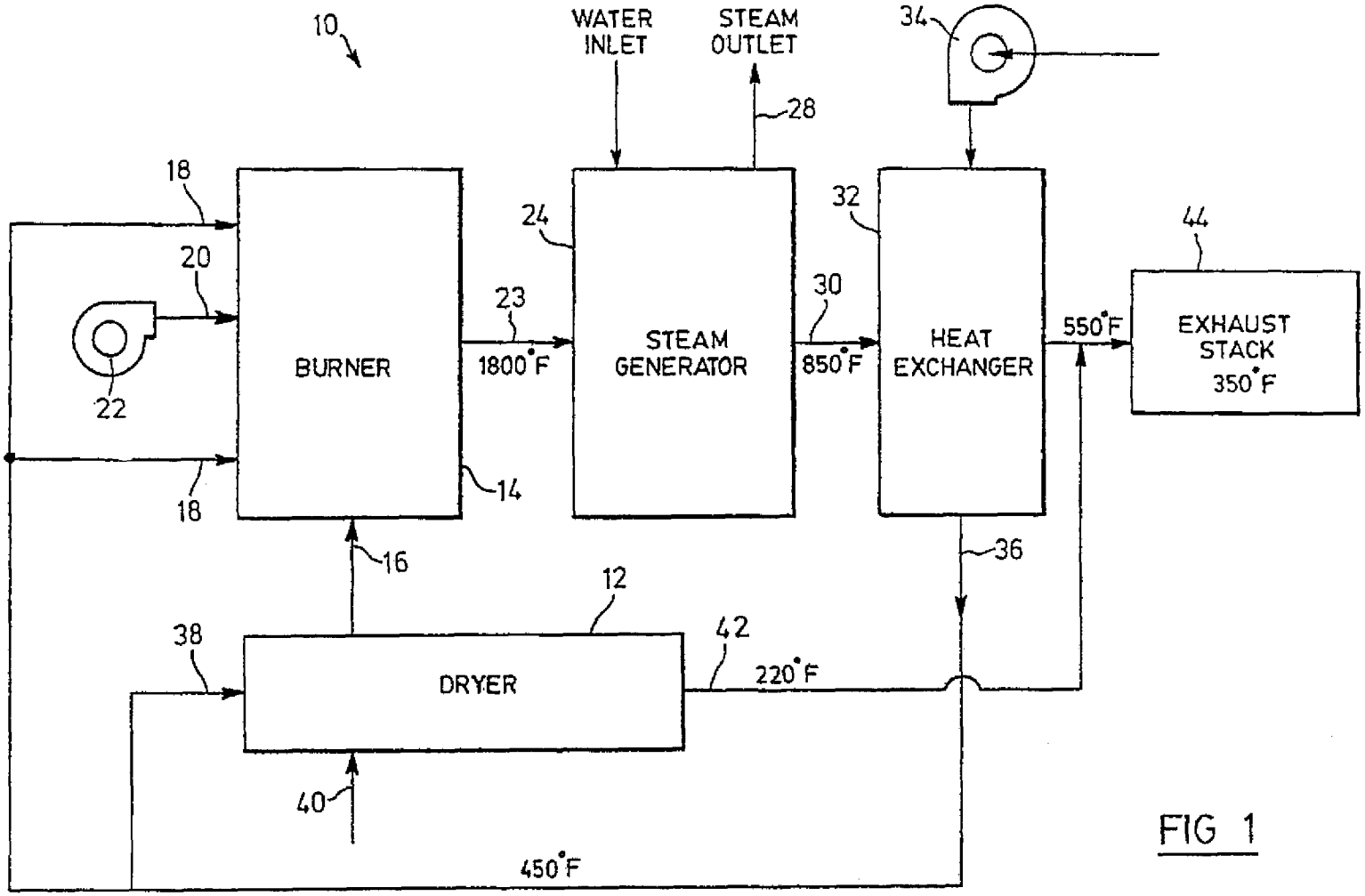
FIG. 1 diagrammatically illustrates a steam generating system employing a dryer according to an embodiment of the present invention.

Reference is made to FIG. 1 which illustrates a steam generating system 10 including a dryer 12 constructed according to a preferred embodiment of the invention. Temperatures indicated on or adjacent to components of the steam generating system 10 are temperatures of intake or output air flows, as the case may be. It will be understood by those skilled in the art that the temperatures of intake and output air flows are intended to be exemplary of the typical system and may be varied in any suitable fashion for particular applications.

The steam generating system 10 includes a solid fuel burner 14 which receives peat moss, wood bark or other similar product at a fuel inlet 16, and air for combustion at air inlets 18 and air inlet 20 which is coupled to an air pump 22. The solid fuel burner 14 has a burner outlet 23 from which air heated to a temperature of about 1,800 degrees Fahrenheit is released.

The heated air generated at the burner outlet 23 is received by a steam generator 24. The steam generator 24 uses the heat received with the air at the burner outlet 23 to generate steam, which is then made available at a steam outlet 28. The air originally received by the steam generator 24 is then exhausted at an air outlet port 30, where it is at a temperature in the order of 850 degrees fahrenheit.

The air escaping from the steam generator 24 at the outlet port 30 is received by a heat exchanger 32. The heat exchanger 32 also receives air at room temperature (approximately 70 degrees fahrenheit) from an air pump 34. The air so received from the air pump 34 is heated by the air escaping from the steam generator 24 to a temperature of about 450 degrees fahrenheit and leaves at an outlet port 36.

The air heated by the heat exchanger 32 is received at an inlet port 38 of the dryer 12, and used to dry wet peat moss or other product received at a wet fuel inlet 40. (Alternatively, the dryer 12 can be made to receive heated air directly from the outlet port 30 of the steam generator 24). The peat moss or other product, once dried, is delivered by a conveyor (not illustrated) to the fuel inlet 16 of the solid fuel burner 14. Water vapor (at a temperature of about 220 degrees fahrenheit) is removed from the dryer 12 at an exhaust port 42 and delivered to an exhaust stack 44, together with exhaust air (at a temperature of about 550 degrees fahrenheit) from the heat exchanger 32. The mean temperature of the stack 44 is in the order of 350 degrees fahrenheit.

The preferred embodiment of the steam generating system 10 is intended to be illustrative of a particular use of the dryer 12, and it is not to be construed as limiting the types of application for which a dryer constructed according to the invention is intended.

Figure 2:
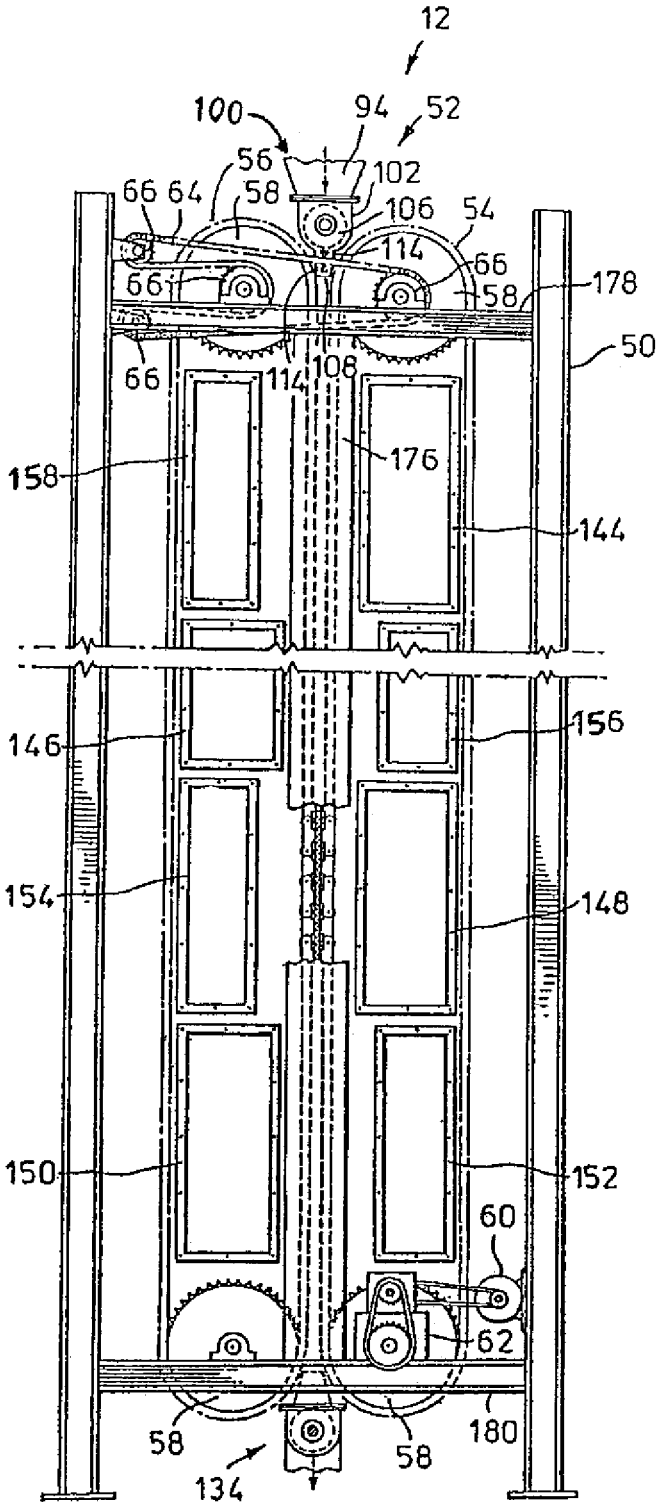
FIG. 2 is an end view of the dryer.
Figure 3:
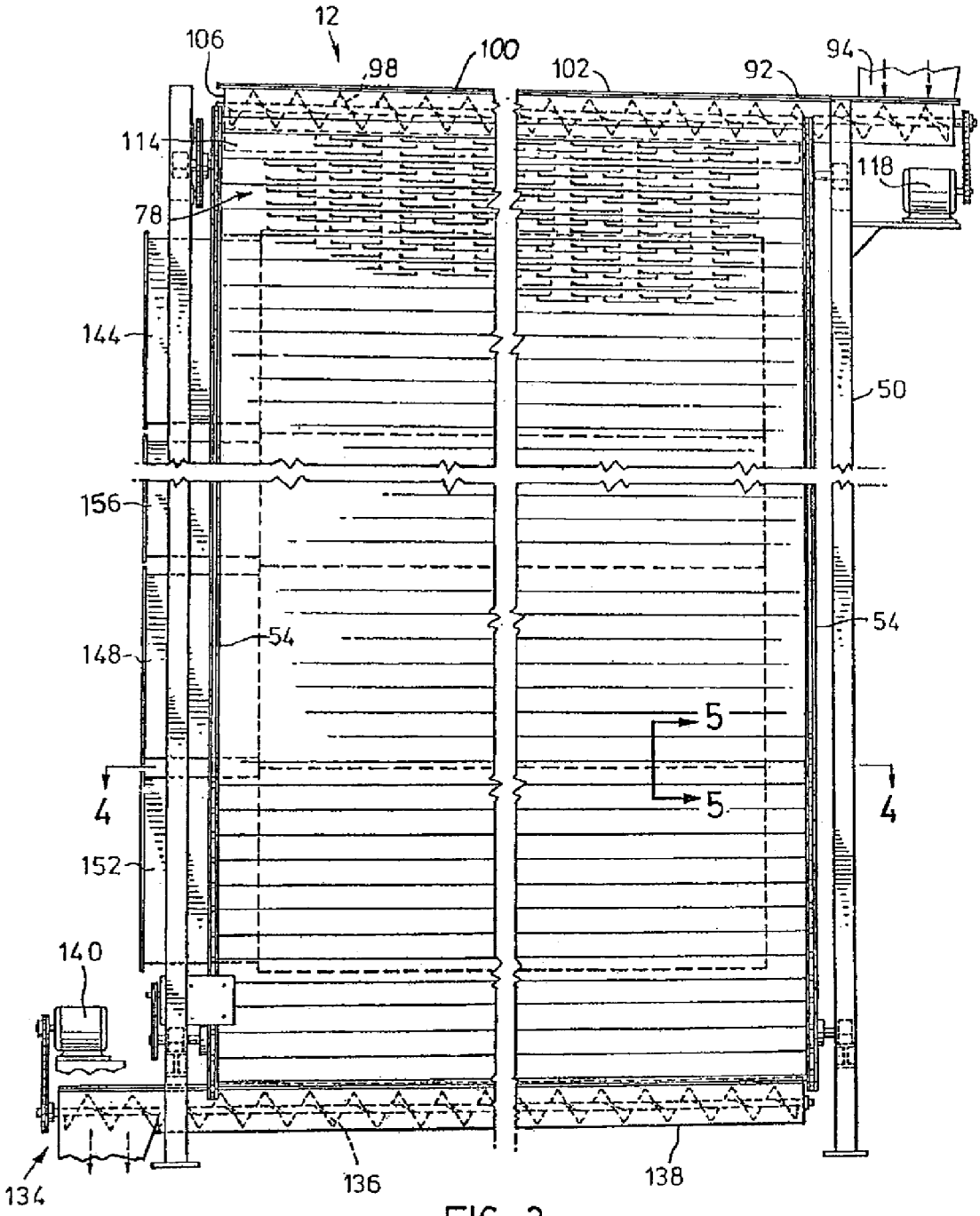
FIG. 3 is a side view of the dryer showing inlet and outlet conveyors and their drive motors.

The dryer 12 according to a preferred embodiment of the invention is better illustrated in the views of FIGS. 2-3.

The dryer 12 has a support frame 50 (constructed of steel I-beams) which supports a dual conveyor 52 suited to the conveying of wood bark, peat moss, sludge, or the like.

The conveyor 52 comprises first and second endless steel belts 54,56. The belts 54,56 are carried by sprockets 58, and driven by a ¾ horsepower electric motor 60 mechanically coupled to one of the sprockets 58 by means of a reduction gear assembly 62. The motion and speed of the belts 54,56 is synchronized by means of a synchronizing chain 64 which moves about synchronizing gears 66 (best illustrated in the view of FIG. 3) two of which are mounted on the axles shown on each of the sprockets 58. Because of this arrangement, the second belt 56 is effectively driven by the first belt 54.

The belts 54,56 have two substantially parallel runs which define down the centre of the conveyor 52 a substantially vertical path (not specifically indicated) having a depth of about three inches, and a width of about 9 feet. The material being conveyed is dried along this vertical path.

The belts 54,56 carry a plurality of rectangular, steel flights 68 (two specifically indicated in end view in FIG. 5) which serve to drive material through the conveyor 52 in a controlled fashion. The motion of the belts 54,56 is so timed that the flights 68 proceed along the vertical path in a paired fashion (see FIG. 5) effectively closing the vertical path and preventing the free-fall of material through the conveyor 52.

The arrangement described above has three principal advantages. First, as the material to be dried moves vertically through the conveyor 52, the motion is assisted by gravity and consequently an electric motor of relatively small horse power can be used to drive the conveyor 52. Second, the vertical arrangement permits conservation of floor space in a plant where the dryer 12 is to be used. Third, fine material is suspended together with coarse material during drying, and consequently a relatively homogeneous dried product is made available, and dust problems are reduced.

The belts 54,56 are preferably constructed of a plurality of flat steel plates which articulate with one another for movement around the sprockets 58. The plates are perforated to permit passage of drying gas into or out of the vertical path during conveyance of a material to be dried.

A plate 70 is typical of those found on the belts 54, 56, and is illustrated in end view in FIG. 5. The plate 70 is provided with upper and lower flanges 72, 74, respectively. A downwardly inclined baffle 76 is preferably integrally formed with the lower flange 74, and serves a function which will be described more fully below.

The plate 70 has punched from its surface a plurality of baffles 78 (only one being specifically indicated in FIG. 5). The baffles 78 incline downwardly when the plate 70 is moving along the vertical path defined between the belts 54,56. As apparent in FIG. 3 (in which the outwardly facing surface of the endless belt 54 is visible) the baffles 78 are arranged in a staggered fashion, which is preferred in order to prevent formation of relatively stagnant or dead pockets of air in the vertical path. It will be appreciated that all plates of the belt 54 are formed with such baffles (which have not been completely illustrated owing to the excessive detail).

The baffles 78 and the apertures provided beneath them permit a drying gas (typically heated air) to be delivered to the material being conveyed and thereafter exhausted in a substantially unobstructed fashion. Because the baffles 78 are downwardly inclined (when they are moving through the vertical path) they tend to prevent the material being conveyed from clogging the openings beneath the baffles 78. Also, because of their downward orientation, the baffles 78 deflect the drying gas downwardly as it enters the vertical path, and then deflect the moisture-laden drying gas upwardly as it is removed. Because the baffles 78 force the drying gas to move in such a fashion, there is less tendency for dust particles to be entrained with the drying gas and thereby removed from the conveyor 52. Additionally, it will be appreciated that the baffles 78 function as flights, which are sufficient for conveying course materials such as peat moss pellets or bark, but that the flights 68 which extend more fully across the vertical path are better suited to conveying materials such as sludge in a controlled fashion.

A plate 80 immediately above the plate 70 has a lower flange 82 (similar to the flange 74 of plate 70). A baffle 84 depends downwardly from the flange 82 (when the plate 80 is moving along the vertical path), and covers the space between the adjacent flanges 72, 82 of the plates 70, 80. The baffle 84 thus serves to prevent lodging of the material being conveyed between the plates 70, 80, and reduces the escape of dust between the flanges 72, 82.

The plates are secured to endless chains 88, 90 which are preferably constructed of flat links (as illustrated in FIG. 6) suited to travel along the teeth of the sprockets 58. FIG. 6 shows the connecting structure of the chain links which is used in a conventional manner to secure the plates to the chain links.

A feed conveyor 92, located at an upper end of the conveyor 52, and secured to the support frame 50 in any suitable manner serves to distribute the material to be dried across the vertical path between the belts 54,56. The feed conveyor 92 comprises a hopper 94 with an open upper face where the material to be dried can be received, as from a conventional conveyor. Preferably, a worm gear 98 contained within a steel housing 100 serves to distribute the material received in the hopper 94 across the vertical path.

Figure 7:
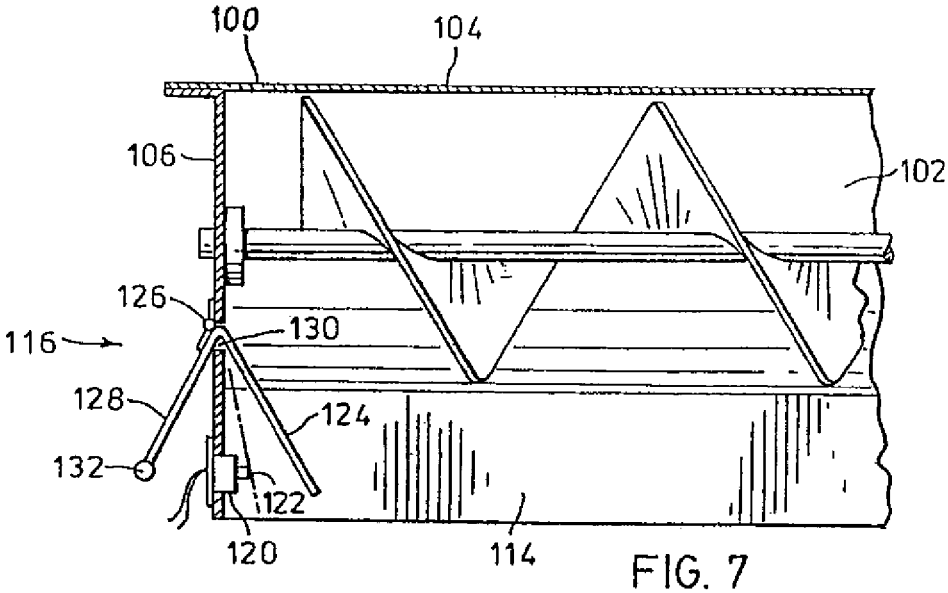
FIG. 7 is a fragmented view illustrating a sensor switch which regulates operation of an inlet screw conveyor, according to an embodiment of the present invention; and, FIG. 8 diagrammatically illustrates control circuitry for use in regulating the operation of the dryer, according to an embodiment of the present invention.

The housing 100 is illustrated in the views of FIGS. 2, 3 and 7. The housing 100 comprises a trough 102 of generally U-shaped cross-section (see FIG. 2) a capping plate 104, and an end plate 106, which can be bolted together in any suitable manner to provide an enclosure along which the worm gear 98 can move material to be dried.

The trough 102 has a longitudinally-directed opening 108 through which the material to be dried can escape into the conveyor 52 (in a substantially controlled fashion) while being moved horizontally by the worm gear 98. The opening 108 has a length corresponding substantially to the width of the belts 54, 56 so that material can be distributed across the full width of the vertical path.

A pair of guide plates 114 extend downwardly from the trough 102, one on either side of the opening 108, substantially parallel to one another, to direct the material to be dried into the conveyor 52. The guide plates 114 incline towards one another slightly, and lower-most edge portions are so spaced that the guide plates 114 can in practice extend substantially into the conveyor 52 (as will be apparent from the view of FIG. 2). Preferably, a certain amount of clearance is provided between the belts 54, 56 and the guide plates 114 to avoid contact between the guide plates 114 and flights 68 during operation.

In practice, the trough 102 need not be provided with a U-shaped cross-section, and a generally rectangular shape may be preferred for ease of construction. If desired, the longitudinal opening provided in the bottom of such a trough can be constructed as several aligned openings, each of which is provided with a sliding gate to regulate aperture size. If the bottom of the trough is flat (as with a rectangular trough), each gate can be constructed of a steel plate with a flange bent from one end portion thereof (for use in sliding the steel plate across one of the openings), and two overhanging lips can be provided in the bottom of the housing to receive oppositely disposed side edge portions of the steel plate to retain the plate and also to guide its sliding motion. The gates so constructed can be used to restrict the rate at which material is delivered to the conveyor 52, and to vary the distribution of material being delivered to the conveyor 52.

The operation of the feed conveyor 92 is preferably regulated by a feed sensor end switch 116 which is detailed in the view of FIG. 7. The function of the feed sensor end switch 116 is to ensure that an excessive amount of material is not delivered to the conveyor 52. To this end, the feed sensor end switch 116 is electrically coupled to and controls the operation of an electric motor 118 (shown in FIG. 3) which drives the worm gear 98.

The feed sensor end switch 116 is mounted on the end plate 106 of the housing 100.

The feed sensor end switch 116 includes a micro-switch 120 activated by a plunger 122, and a plate 124 which pivots about a hinge 126 attached to the end plate 106. The plate 124 is deflected by material delivered through the opening 108 by the worm gear 98, and when so deflected depresses the plunger 122 of the micro-switch 120. A lever arm 128 extends through an opening 130 in the end plate 106 and supports a counterweight 132. The counterweight 132 ensures that the plunger 122 is not depressed by the plate 124 until some predetermined build-up of material occurs at the upper end of the conveyor 52. In practice the appropriate choice of a weight for the counterweight 132 will depend principally on the type of material which is being dried, generally increasing with the density of the material. Alternatively, a spring can be mounted between the plate 124 and the end plate 106 to bias the plate 124 away from the micro-switch 120.

When the plunger 122 is depressed, the motion of the electric motor 118 is stopped. Consequently no further material is delivered to the conveyor 52 until any backlog which has occurred at the upper end of the conveyor 52 is cleared. The feed sensor end switch 116 is preferably coupled as well to the conveyor which feeds the feed conveyor 92 so that no further material is delivered to the hopper 94.

A discharge conveyor 134 (shown in FIGS. 2 and 3) is attached to the support frame 50 at a lower end of the conveyor 52. The discharge conveyor 134 is positioned directly beneath the vertical path to receive and carry away material dried by the dryer 12.

The discharge conveyor 134 has a structure similar to that of the feed conveyor 92. The discharge conveyor 134 comprises a worm gear 136 disposed in a trough-like housing 138 (an upper face of which is open to receive material from the dryer 12). An electric motor 140 (indicated in FIG. 3) rotates the worm gear 136 to advance the dried material towards a discharge hopper where it can be carried away by any of a variety of means.

The operation of the discharge conveyor 134 need not be regulated by any type of feed sensor switch; the worm gear 136 need simply be made to rotate at a speed sufficient to ensure that all material possibly delivered to the trough-like housing 138 is carried away.

The construction, mounting and operation of dryer ductwork will now be described with reference primarily to FIGS. 2, 3 and 4. As will be apparent from FIG. 2, the dryer 12 comprises four substantially identical intake ducts 144, 146, 148, 150, and four substantially identical exhaust ducts 152, 154, 156, 158, paired as shown.

These ducts are mounted in the interior of the endless belts, as apparent in FIG. 2, with substantially only intake and exhaust ports extending from within the belts. The motion of drying air in and out of two typical ducts is indicated by arrows in the view of FIG. 4. Preferably, the particular arrangement of ducts is such that two pairs of intake-exhaust ducts (pair 144,158 and pair 148,154) direct drying air in a first direction across the vertical path, and the remaining two pairs (pair 146,156 and pair 150,152) direct drying air in an opposite direction, thereby preferably ensuring that the material conveyed tends to dry equally on either side of the path. It will be understood by those skilled in the art that the word "across", as used in reference to the flow of the drying gas in relation to the vertical path, means any direction except other than vertical.

The pair feed and exhaust ducts 150, 152 (whose construction and relative orientation are typical of all the ducts) are better illustrated in the plan view of FIG. 4. The ducts 150,152 may be constructed primarily of sheet metal, and are preferably substantially identical in structure. Preferably, the intake port 160 of the feed duct 150 is about 50% larger than the exhaust port 162 of the exhaust duct 152 (with attendant changes in the dimensioning of the body of the ducts) to reflect the fact that hot air delivered to the conveyor 52 will cool and contract considerably before being exhausted from the dryer 12.

Only the exhaust duct 152 will be described in detail, as the remaining ducts preferably have substantially identical structure. The exhaust duct 152 has two openings. One such opening is in the exhaust port 162, and the second is an open face (not specifically indicated) which extends substantially from top to bottom of the exhaust duct 152. When the dryer 12 is assembled, the open face is preferably positioned immediately adjacent to one side of the vertical path, that is, substantially parallel and adjacent to the vertical run of the endless belt 54 defining one side of the vertical path. A corresponding face of the feed duct 150 is similarly positioned adjacent to a vertical run of the endless belt 56, opposite the feed duct 150. In this manner the feed duct 150 can deliver heated drying air to one side of the vertical path, and the exhaust duct 152 can exhaust moisture-laden drying air on the opposite side.

The open face of the exhaust duct 152 is placed in substantially sealing engagement against the vertical run of the endless belt 54. To this end, a sealing strip 166 (which may be constructed in four lengths) is secured by means of a metal retaining strip (together with pop rivet or bolts) to inside surfaces of the exhaust duct 152. The sealing strip 166 circumscribes the open face, and contacts an inside surface of the endless belt 52, as illustrated in the view of FIG. 5.

In FIG. 5, end walls of the ductwork have been broken away to reveal chains supporting the endless belts 54, 56, and consequently only an upper run of the sealing strip 166 is illustrated therein. It will be appreciated that in the context of a mechanical device such as the dryer 12 perfect sealing engagement will be difficult if not impossible to achieve, and that where sealing engagement is mentioned in this specification leakage of air can be tolerated provided that a greater part of the drying air delivered by a feed duct to the vertical path is exhausted through a corresponding exhaust duct.

The manner of mounting of the feed and exhaust ducts 150, 152 is typical of all ducts of the dryer 12. The ducts 150, 152 are supported from the framework 50 by means of oppositely disposed mounting assemblies generally indicated by the reference numerals 172, 174. The mounting assemblies 172,174 are substantially identical in structure, and consequently only the mounting assembly 172 will be described in detail.

The mounting assembly 172 comprises an elongate, rectangular backing plate 176 which is secured by bolts to the support frame 50. The backing plate 176 is substantially vertically disposed in the support frame 50, is shown (fragmented) in the view of FIG. 2.

A channeled guide member 178 is bolted to the backing plate 176. The guide member 178 has a substantially uniform cross-section (shown in the plane of FIG. 4) defining two channels 180 which serve to guide the chains carrying the endless belts 52, 54.

A number of connecting flanges are welded to the guide member, and corresponding connecting flanges are secured to the feed and exhaust ducts 150, 152. The paired connecting flanges have holes which can be placed in registration and through which a bolt can be passed in order to secure the ducts 150,152 to the guide member 178 and backing plate 176. Three pairs of connecting flanges support each duct, one pair located towards the top of each duct, one pair, toward the bottom of each duct, and one pair disposed substantially midway between the two other pairs.

The basic operation of the dryer 12 according to a preferred embodiment of the present invention is as follows. The material to be dried is distributed by the feed conveyor 92 across the vertical path defined through the conveyor by the endless belt 54, 56. The material is then conveyed through the conveyor 52 by the flights 68 of the belts 54, 56 (which flights prevent the free-fall of material through the conveyor 52 under gravity). With coarse materials, it will be apparent that the baffles of the plates constituting the endless belts 54, 56 serve also as flights conveying the materials.

Heated drying air is delivered from any appropriate source (for example, the heat exchanger 32 of FIG. 1) to the feed ducts, is then delivered by the feed ducts to the material being conveyed, and is then removed by the exhaust ducts. The exhaust ducts are preferably coupled by ductwork to an air pump (not shown) which serves to draw the moisture-laden drying air into the exhaust ducts; and the scattering of dust from the dryer 12 can be significantly reduced by utilizing suction as the means by which the drying air is drawn from the feed ducts into the vertical path. The particular arrangement of feed and exhaust ducts illustrated, that is, one which allows for the flow of drying gas in opposite directions across the vertical path, is preferable because it causes the material being conveyed to be dried more evenly on both sides of the conveyor 52, as mentioned above.

Dust loss from the dryer 12 may be reduced in several ways. First, drying air is preferably drawn through the dryer 12 by means of suction applied at the exhaust ducts, rather than being forced under positive pressure into the intake ducts. The tendency for dust to be scattered from the conveyor 52 is thereby significantly reduced. In practice, the volume and rate at which air is to be drawn from the exhaust ducts (by an air pump or the like) will be determined principally by the moisture content of the material being dried, the rate at which the material is being conveyed, and the temperature of the incoming drying air.

Second, the channeled guide member 178 may be provided with an elongate surface 192 (indicated in FIG. 4) which is positioned immediately adjacent the side edge of the chains carrying the endless belts 54, 56 to close off one side of the vertical path, thereby reducing dust scattering. (A similar surface will be found on the corresponding guide member on the opposite side of the dryer 12). Consequently, the surface 192 is preferably positioned as close to the chains of the endless belts 54, 56 as possible without interfering with their motion. To this end the backing plate 176 which supports the guide member 182 is preferably bolted to the support frame in such a manner that the spacing between the surface 192 and the endless belts 54, 56 can be adjusted by appropriate insertion or deletion of washers or shins.

As mentioned above, the entrainment of dust particles with drying air is reduced by the provision of air-deflecting baffles on the panels constituting the endless belts 54,56. By upwardly directing the air flow out of the conveyor 52, the baffles encourage fine particles to remain in the material being conveyed, instead of escaping into the dryer exhaust ducts.

Figure 8:
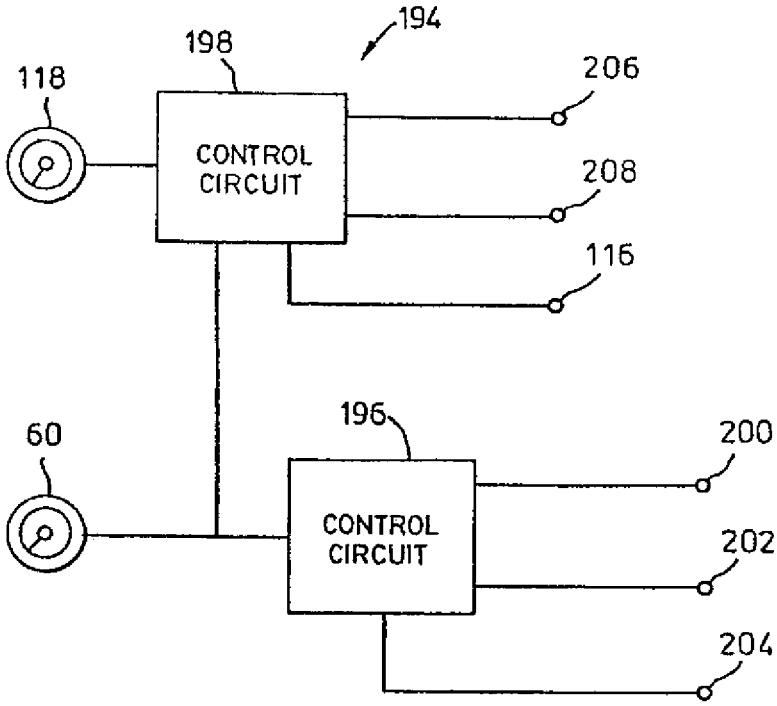

A dryer control system 194 according to the preferred embodiment is illustrated diagrammatically in FIG. 8. The control system 194 comprises a controller, which preferably includes two control circuits 196, 198 which provide drive signals respectively to the motor 60 which operates the conveyor 52 and to the motor 118 which operates the feed conveyor 92.

The control circuit 196 receives a boiler steam demand signal (from the steam generator 35 in FIG. 1, for example) at a terminal 200. The control circuit 196 generates therefrom a conveyor drive signal which is preferably directly proportional to the boiler steam demand signal and which preferably directly varies the speed of the motor 60. Preferably, the speed of the conveyor 52 thus varies directly with the boiler steam demand signal.

In addition, the control circuit 196 receives a temperature signal from a temperature sensor 202 located in the exhaust duct 158. Preferably, the conveyor drive signal is then reduced in magnitude by a signal proportional to the excess of the temperature signal over a predetermined reference temperature signal generated by the control circuit 196. Thus, if the material conveyed is excessively damp, the temperature of the moisture-laden drying gas in the exhaust duct 158 will tend to be reduced from some predetermined reference temperature (for example 210° F. when the material being dried is wood bark), and the conveyor 52 will be slowed by the control circuit 106 to permit more thorough drying.

If desired, a second temperature sensor 204 can be disposed in the feed duct 144 to sense the temperature of the incoming drying air. The control circuit 196 can then generate a temperature differential signal indicative of the temperature drop occurring in the drying air, and consequently more accurately reflecting the moisture content of the material being conveyed and the extent to which heat is being lost to the moisture. The conveyor drive signal can then be reduced in magnitude by a signal proportional to the excess of the temperature differential signal over some predetermined reference temperature differential signal. The conveyor 52 may thus be slowed by the control circuit 196 to increase the extent to which the material conveyed is dried until the predetermined temperature differential signal is established between the feed and exhaust ducts 144, 158.

Preferably, the control circuit 198 receives from the control circuit 196 the conveyor drive signal, and scales that signal to produce a feed conveyor control signal which varies the speed of operation of the motor 118. The control circuit 198 also receives pressure signals from a high pressure sensor 206 located in the feed duct 144 and a low pressure sensor 208 in the exhaust duct 158. The control circuit 198 generates therefrom a pressure differential signal indicative of the pressure difference between the feed and exhaust ducts 144,158. The control circuit 198 then reduces the feed conveyor drive signal by an amount proportional to the excess of the pressure differential signal over some predetermined pressure differential reference signal. Since the pressure differential signal will be indicative of the density of packing of the material to be dried in the conveyor 52, the operation of the feed conveyor 92 will be slowed when excessive quantities of material, quantities which cannot be adequately dried, are being delivered to the conveyor 52.

The operation of the feed sensor switch 116 has been described above. When the feed sensor end switch 116 is activated, indicating that material is backing up at the top of the conveyor 52, preferably the control circuit 198 merely shuts down the operation of the motor 118 and feed conveyor 92.

A preferred embodiment of a dryer constructed according to the invention has been described above, and it will be appreciated that various changes may be made to the preferred embodiment described without departing from the scope or spirit of the invention.

The invention claimed is:

1. A dryer for drying a material to be used as fuel using a drying gas, the dryer comprising:

a conveying means for conveying the material to be dried along a substantially vertical path extending between an upper end of the conveying means where the material is received and a lower end of the conveying means where the material is discharged; and, a directing means for directing the drying gas across the vertical path to remove moisture from the material as the material is conveyed along the vertical path, the directing means comprising a feed duct means for use in delivering the drying gas to the conveying means on a first side of the vertical path, and an exhaust duct means for withdrawing the drying gas from the conveying means on a second side of the vertical path;

wherein the conveying means comprises a plurality of flights connected to a conveyor, the conveyor having a substantially vertical first run and a substantially vertical second run, the first run defining the first side of the vertical path and the second run defining the second side of the vertical path;

wherein a first group of the plurality of flights is connected to the first run and a second group of the plurality of flights is connected to the second run, wherein the plurality of flights convey the material along the vertical path, wherein the plurality of flights move through the vertical path in pairs, each pair of flights being defined by a flight of the first run and a flight of the second run disposed in side-by-side relationship, wherein the vertical path is effectively closed by each pair of flights, thereby constraining the material from moving along the vertical path faster than the flights wherein the first run comprises a first endless belt and the second run comprises a second endless belt, wherein the first and second endless belts move downwardly through the vertical path;

wherein each of the first and second endless belts comprises a plurality of first plates and a plurality of second plates, wherein the first and second plates are vertically oriented when located in the vertical path;

wherein one of the flights is connected to each first plate;

wherein each second plate comprises: (i) an upper flange projecting transversely from an upper end of the second plate into the vertical path; and (ii) a lower flange projecting from a lower end of the second plate into the vertical path;

wherein a space is defined between the upper flange and the lower flange of adjacent second plates to permit the drying gas to enter the vertical path; and wherein the upper flange and lower flange leave a portion of the vertical path open for movement of the fuel material.

2. The dryer of claim 1 in which:

the feed duct means defines a first open face, adjacent to the first vertical run, wherein the first open face is adapted to deliver the drying gas through the first vertical run to the first side of the vertical path; and, the exhaust duct means defines a second open face, adjacent to the second vertical run, wherein the second open face is adapted to receive moisture-laden drying gas to be withdrawn through the second vertical run from the second side of the vertical path.

3. The dryer of claim 2, further comprising:

a first sealing means located about the first open face of the feed duct means, wherein the first sealing means seals the first vertical run against the first open face for preventing mixing of heated drying gas with ambient air between the first open face of the feed duct means and the first vertical run; and, a second sealing means located about the second open face of the exhaust duct means, wherein the second sealing means seals a the second vertical run against the second open face for preventing the mixing of moisture-laden drying gas with ambient air between the second open face of the exhaust duct means and the second vertical run.

4. The dryer of claim 1 in which each of the plurality of first plates and second plates are adapted to articulate with one another, wherein the first and second plates define at least one aperture in an interior portion thereof to permit the passage of drying gas through the first and second plates.

5. The dryer of claim 4 in which the first and second plates comprise a baffle connected to the first and second plates above the aperture, wherein the baffle is inclined downwardly over the aperture.

6. The dryer of claim 1 in which the lower flange of the second plate comprises a downwardly inclined portion extending toward the upper flange of an adjacent second plate.

7. The dryer of claim 1, wherein the first and second endless belts are synchronized.

8. A dryer for drying a fuel material using a drying gas, the dryer comprising:

a conveyor having a substantially vertical first run and a substantially vertical second run, the first run defining a first side of a substantially vertical path and the second run defining a second side of the vertical path;

a plurality of flights, wherein a first group of the plurality of flights is connected to the first run and a second group of the plurality of flights is connected to the second run, wherein the plurality of flights convey the fuel material along the vertical path, wherein the plurality of flights move through the vertical path in pairs, each pair of flights being defined by a flight of the first run and a flight of the second run disposed in side-by-side relationship, wherein the vertical path is effectively closed by each pair of flights, thereby constraining the fuel material from moving along the vertical path faster than the flights;

at least one feed duct located on the first side of the vertical path, the at least one feed duct adapted for directing the drying gas substantially across the vertical path; and at least one exhaust duct located on the second side of the vertical path, the at least one exhaust duct adapted for receiving the drying gas wherein the first run comprises a first endless belt and the second run comprises a second endless belt, wherein the first and second endless belts move downwardly through the vertical path;

wherein each of the first and second endless belts comprises a plurality of first plates and a plurality of second plates, wherein the first and second plates are vertically oriented when located in the vertical path;

wherein one of the flights is connected to each first plate;

wherein each second plate comprises: (i) an upper flange projecting transversely from an upper end of the second plate into the vertical path; and (ii) a lower flange projecting from a lower end of the second plate into the vertical path;

wherein a space is defined between the upper flange and the lower flange of adjacent second plates to permit the drying gas to enter the vertical path; and wherein the upper flange and lower flange leave a portion of the vertical path open for movement of the fuel material.

9. The dryer of claim 8, wherein:

the feed duct defines a first open face, proximate to the first vertical run, wherein the first open face is adapted to deliver the drying gas through the first vertical run to the one side of the vertical path; and, the exhaust duct defines a second open face, adjacent to the second vertical run, wherein the second open face is adapted to receive the drying gas to be withdrawn through the second vertical run from the second side of the vertical path.

10. The dryer of claim 9, further comprising:

a first seal located about the first open face of the feed duct, wherein the first seal seals the first vertical run against the first open face for preventing mixing of drying gas with ambient air between the first open face of the feed duct and the first vertical run; and, a second seal located about the second open face of the exhaust duct, wherein the second seal seals a the second vertical run against the second open face for preventing the mixing of moisture-laden drying gas with ambient air between the second open face of the exhaust duct and the second vertical run.

11. The dryer of claim 8, wherein each of the plurality of first and second plates are adapted to articulate with one another, wherein the first and second plates define at least one aperture in an interior portion thereof to permit the passage of drying gas therethrough.

12. The dryer of claim 11, the first and second plates comprise a baffle connected to the first and second plates above the aperture, wherein the baffle is inclined downwardly over the aperture.

13. The dryer of claim 8, wherein the lower flange of the second plate comprises a downwardly inclined portion extending toward the upper flange of an adjacent second plate.

14. The dryer of claim 8, wherein the first and second endless belts are synchronized.

* * * * *